US005542676A

United States Patent [19]

Howe, Jr. et al.

[11] Patent Number: 5,542,676

[45] Date of Patent: Aug. 6, 1996

[54] BIOSENSOR FEEDBACK DEVICE FOR SPORTING IMPLEMENTS

[75] Inventors: Maynard A. Howe, Jr.; Jeffrey M. Eliason, both of St. Paul, Minn.

[73] Assignee: Soundadvice for Sports, Inc., St. Paul, Minn.

[21] Appl. No.: 245,746

[22] Filed: May 18, 1994

Related U.S. Application Data

[63] Continuation-in-part of Ser. No. 16,873, Feb. 11, 1993, abandoned.

[51] Int. Cl.[6] ..... A63B 69/36; G08B 21/00

[52] U.S. Cl. ..... 473/202; 273/75; 340/665

[58] Field of Search ..... 273/186.1, 187.4, 273/187.5, 187.2, 186.2, 35 R, 75, 67 DB, 29 R, 26 B, 81 R; 340/665

[56] References Cited

U.S. PATENT DOCUMENTS

| | | | |
|---|---|---|---|
| 3,111,322 | 11/1963 | English . | |
| 3,323,367 | 6/1967 | Searle . | |
| 3,762,720 | 10/1973 | Jett . | |
| 3,897,058 | 7/1975 | Koch . | |
| 4,103,896 | 8/1978 | Lorang . | |
| 4,138,118 | 2/1979 | Budney . | |
| 4,524,973 | 6/1985 | Sterbik . | |
| 4,861,034 | 2/1989 | Lee . | |
| 4,912,836 | 4/1990 | Avetoom | 273/81 R |
| 4,930,785 | 6/1990 | Mills . | |
| 5,072,077 | 12/1991 | Klein . | |
| 5,221,088 | 6/1993 | McTeigue et al. . | |
| 5,377,541 | 1/1995 | Patten | 273/187.5 |

FOREIGN PATENT DOCUMENTS

| | | |
|---|---|---|
| 2626483 | 8/1989 | France . |

OTHER PUBLICATIONS

Packaging for Tennis Whatagrip, manufactured by Unique Sports Products Inc., Atlanta, Georgia 30201.

*Primary Examiner*—Sebastiano Passaniti
*Attorney, Agent, or Firm*—Gregory P. Kaihoi

[57] ABSTRACT

A biosensor feedback device for use in detecting a grip pressure and torque of a hand against a handle of a sporting implement. The device includes a flexible thin film substrate which is conformable to the handle of the sporting implement, and an array of digital pressure sensors disposed on the flexible substrate. The sensors are connected to a signal, such as a buzzer, that indicates detection of pressure or torque exceeding a desired threshold. The array of sensors can be divided into two or more sub-arrays of sensors of different sensitivities, and each of the sub-arrays can be connected to (or disconnected from) the signal as desired. The sensor-beating substrate is secured to the handle of the sporting implement by an elongated, stretchable tubular sheath. This sheath is capable of being manipulated from a first position, in which it is rolled substantially entirely onto itself to form a generally doughnut-shaped roll, to a second position in which it is unrolled over the sensor substrate to secure the substrate to the handle of the sporting implement.

18 Claims, 9 Drawing Sheets

Fig. 15
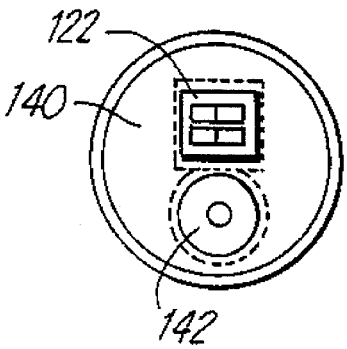
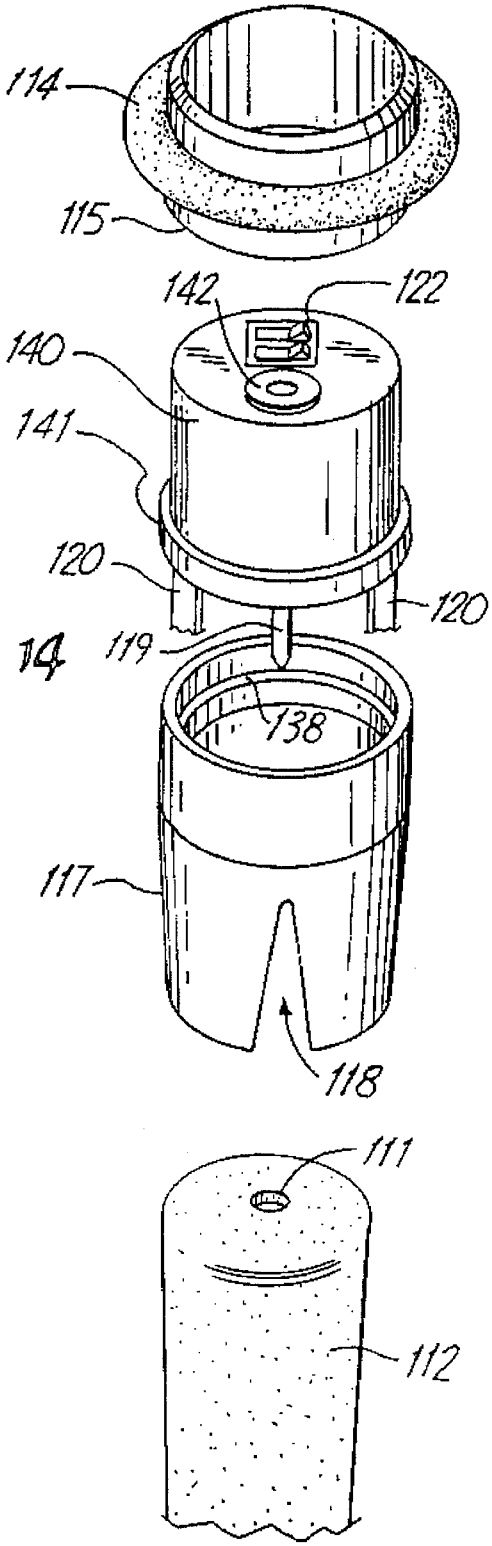
Fig. 14

BIOSENSOR FEEDBACK DEVICE FOR SPORTING IMPLEMENTS

RELATED APPLICATIONS

This application is a continuation in part of application Ser. No. 08/016,873, filed Feb. 11, 1993 now abandoned.

FIELD OF THE INVENTION

The invention relates to a biofeedback device usable in conjunction with sporting implements, such as golf clubs, tennis rockets, baseball bats, firearms, and the like. In particular, the invention provides biofeedback to the user of the implement regarding the amount of pressure being exerted on the handle of the implement.

BACKGROUND OF THE INVENTION

In a variety of sports, such as golf, tennis, baseball and the like, a person's grip on the handle of the club (or other sporting implement) can be critical to the degree of success the person has in the sport. For example, in golfing, many golfers are unable to consistently produce a smooth swing without jerking or otherwise changing strength of their grip midswing. Such jerking or changes in grip (or strength of grip) disrupt the smooth flow of a swing, causing the golfer to slice, hook, or otherwise inaccurately hit the ball. Conversely, players who are able to avoid such dysfunctions in their swing are able to more consistently hit the ball accurately.

Similar smoothness of stroke is desirable in many other sports utilizing hand-held implements, such as tennis rackets, baseball bats, and the like, and even firearms (where the sportsman frequently may jerk when pulling the trigger or prematurely move the firearm in anticipation of the firearm's natural recoil when discharged). Thus, in many such areas of sporting, them is a need for a biofeedback device which will signal to the sportsman significant changes in the sportsman's grip (or strength of grip) on the handle of the sporting implement being utilized.

Devices attempting to fill this need have been proposed. For example, U.S. Pat. No. 3,323,367 (R. W. Searle) describes a "grip indicator" having a pair of resistive sensors connected in a conventional bridge circuit to a zero-centered ammeter mounted on the shaft of a golf putter. One of the pressure sensitive resistive sensors is located on the handle in a position corresponding to the left hand position of the golfer, and the other sensor is positioned for the right hand. By viewing the position of the needle on the ammeter, the golfer can visually confirm that his grip is equally balanced between his two hands. Although the invention is also described as being applicable to tennis racket handles, the utility of the device is somewhat limited by the need for the sportsman to actually view the position of the needle on the ammeter during use of the putter or racket. This limitation significantly affects the utility of the device when used other than in gentle strokes (such as with a putter).

U.S. Pat. No. 4,138,118 (D. R. Budney) provides an improvement over the Searle indicator, in that Budney connects two or three analog pressure-sensitive transducers to a chart recorder which graphically depicts the amount of force being exerted on each pressure transducer during the swing of a golf club. The devices uses two, or, at most, three transducers on the handle of the club, independently charting the force applied to each such transducer. Analysis of the printout of the chart recorder reveals the faults in the player's swing, permitting after-the-fact diagnosis of the swing. The device does not provide real time feedback to the golfer, however, and requires an electrical cable connecting the club to a portable chart recorder, making the device somewhat cumbersome to utilize.

U.S. Pat. No. 4,861,034 (S. Y. Lee) describes a grip training device attachable to (and removable from) the handle of a golf club. An elongated pressure sensitive switch is mounted on the underside of the handle, and is responsive to the grip pressure of the golfer. The switch is formed of three resilient conducting strips spaced from one another by compressible foam blocks. When grip pressure is sufficient to compress one of the resilient, conducting strips against an adjacent strip, a circuit is completed causing a battery powered buzzer to emit an audible signal. The Lee device is relatively thick in relation to the thickness of a golf club handle, and consequently affects the normal grip of the golfer. Moreover, the device provides pressure sensing only on the underside of the club handle, and therefore cannot detect pressure of the golfer's hands against other portions of the handle.

In addition to the above referenced patents, other similar biofeedback devices have been proposed. In most cases, however, such devices are complicated to use, interfere with ordinary grip and/or use of the sporting implement, and/or are quite expensive.

SUMMARY OF THE INVENTION

The invention provides a relatively simple, versatile biosensor feedback device for use in detecting swing torque and grip pressure of a hand against a handle of a sporting implement (such as a golf club, tennis racket, etc.). The device utilizes electronic pressure detection means for detecting and signalling hand pressure on the sporting implement handle exceeding a predetermined level. The pressure detection means preferably includes one or more portions of sensor substrate being shaped and sized to extend along at least a substantial portion of the sporting implement handle, the sensor substrate being generally conformable to the handle and including pressure sensor means (such as an array of digital pressure-sensitive switches) for sensing grip pressure and swing torque.

The device also includes attachment means for securing the sensor substrate to the handle of the sporting implement. The attachment means includes an elongated, stretchable tubular sheath which is capable of being manipulated from a first position, in which it is rolled substantially entirely onto itself to form a generally doughnut-shaped roll, to a second position in which it is unrolled over the sensor substrate to secure the sensor substrate to the handle of the sporting implement. The tubular sheath preferably is made from a thin latex rubber, having a thickness of less than 0.1 inches, and preferably less than 0.04 inches. Preferably the tubular sheath is mounted on a removable collar, permitting easy replacement of the tubular sheath as desired by the sportsman.

The electronic pressure detection means includes means for signaling excessive hand pressure, such as a buzzer or light emitting diode (LED). A personal listening system may also be utilized, such as a pneumatic tube connecting the buzzer to an earpiece—this allows the person using the device to receive the feedback from the unit without disturbing others in the vicinity (and/or without allowing others to detect when feedback is being given by the device).

In a preferred embodiment, the array of sensors includes two or more sub-arrays of sensors, each sub-array being configured to detect a different preselected level of swing torque or grip pressure, and each such sub-array being selectively (and independently) connectable to the signal means. In this way, the sportsman can select which level(s) of pressure sensitivity will be detected. Desirably, sensors corresponding to each of the sub-arrays are generally uniformly distributed throughout the overall array, and desirably, that portion of the sporting implement handle which is typically contacted by the sportsman's hand(s) is generally uniformly covered by the array of sensors.

In a preferred embodiment, each pressure sensor comprises an electrical, pressure sensitive switch. Each such switch includes a first flexible conductive path carried on a first thin film substrate, and a second flexible conductive path carried on a second thin film flexible substrate. The second conductive path is aligned with the first conductive path, and spacer means is provided for normally spacing the first conductive path away from the second conductive path. The spacer means is sized and located so as to permit the second conductive paths to contact the first conductive path when pressure exceeding a selected level is exerted on the portion of the second flexible substrate carrying the second conductive path. Using such thin film technology, an array of such switches can be easily manufactured to be less than 0.1 inches thick (including the thickness of the substrates)—desirably the switches are not more than about 0.03 inches thick, and most preferably, the switches are less than about 0.02 inches thick. Such thin film switches therefore add only an insignificant thickness to the handle of the implement, and do not interfere with the sportsman's normal grip. Moreover, they can be manufactured quite economically.

BRIEF DESCRIPTION OF THE DRAWINGS

FIG. 14 is a broken-away, exploded perspective view of the embodiment of FIGS. 11–13;

FIG. 15 is a top view of the same embodiment; and

BEST MODE FOR CARRYING OUT THE INVENTION

Figure 1:
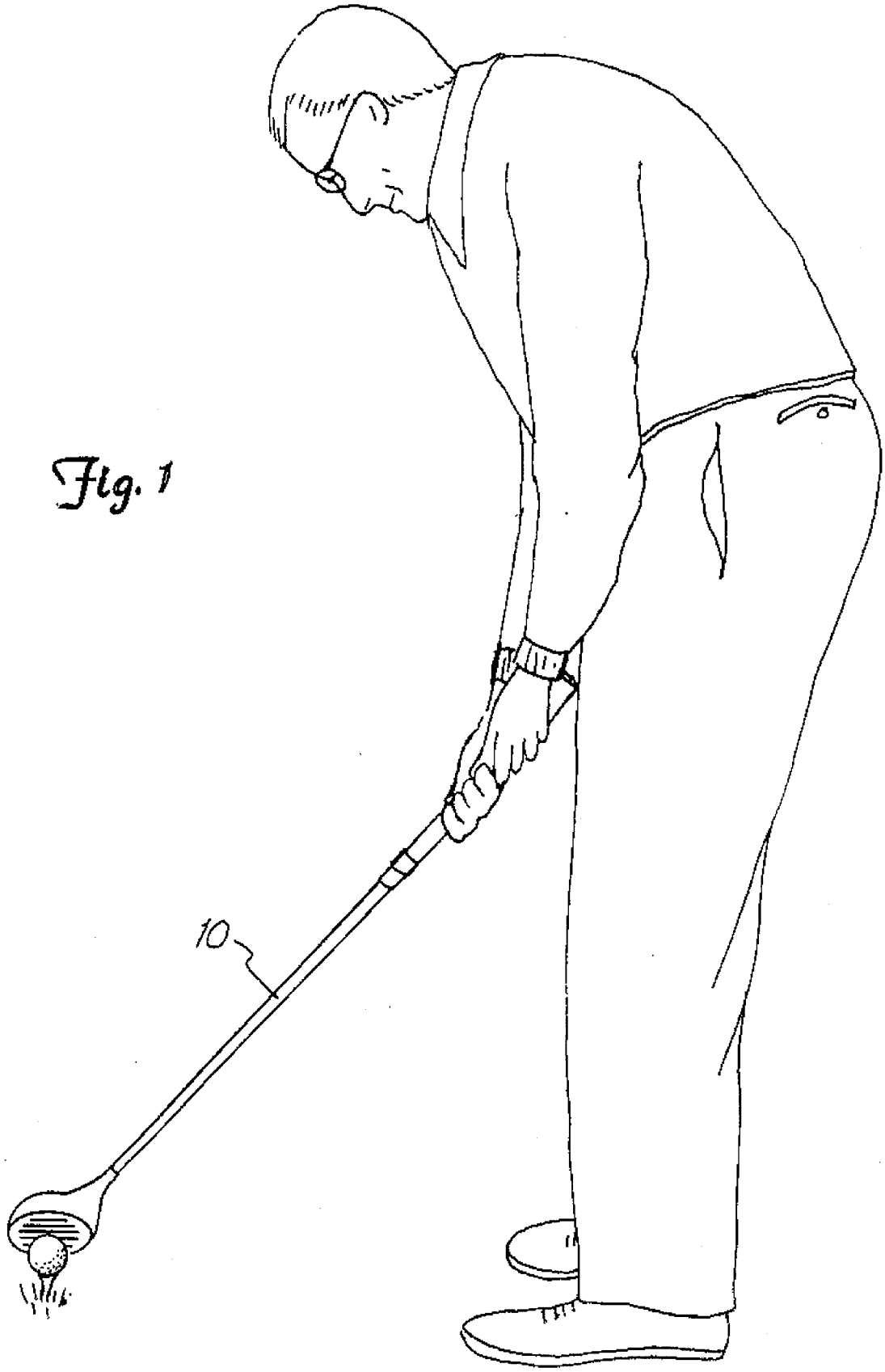
FIG. 1 shows a golfer using a golf club on which has been mounted a biosensor feedback device of the invention.

Although FIG. 1 (and the remaining drawings) illustrate the invention in connection with use on the handle of a golf club, as indicated above the invention is suitable for use in connection with any sporting implement having a handle normally gripped by the sportsman, including, without limitation, golf clubs, tennis rackets, baseball bats, softball bats, racquet ball rackets, and the like, as well as firearms. The utility, and therefore applicability, of the invention will be found wherever it is desired to train a sportsman to utilize a grip of generally constant strength and/or control swing torque (although references will frequently be made herein to grip pressure and/or swing torque, it should be understood that both concepts are often involved in many applications of the invention, whether or not express reference is made to both concepts in every instance).

Figures 2, 3:
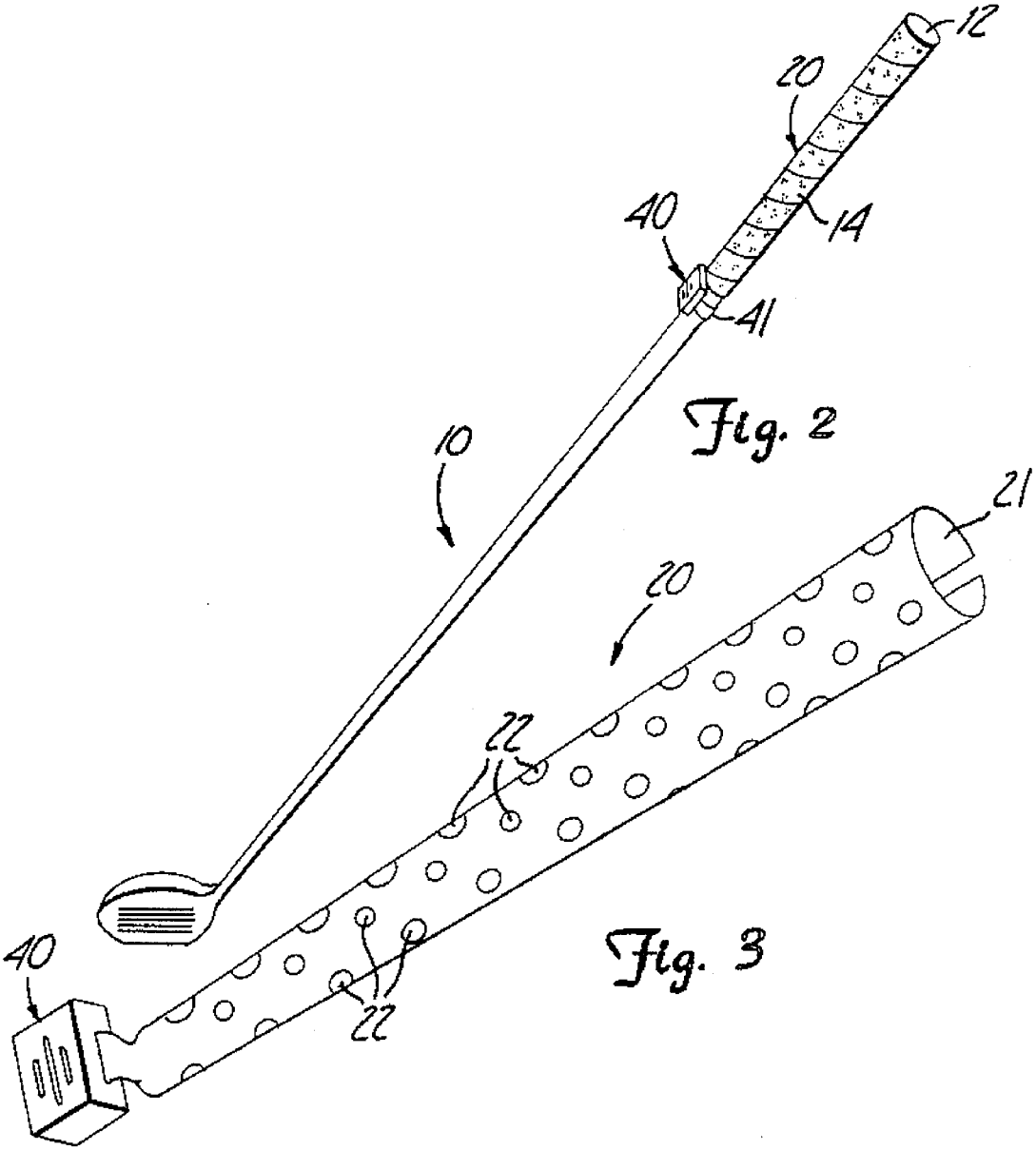
FIG. 2 is a perspective view of a golf club on which has been mounted a biosensor feedback device of the invention.
FIG. 3 is a perspective view of one embodiment of the device of the invention.

FIG. 2 depicts a first embodiment of the invention secured to the handle 12 of a golf club 10 by a spiral wrapping material 14. FIG. 3 depicts in larger, somewhat schematic fashion, this embodiment of the invention, which includes an array 20 of sensors 22 carried on a flexible, thin film substrate 21. A biofeedback signal device, designated generally as 40, is secured to the shaft of the golf club 10 by a suitable collar or band 41, and is electrically connected to the array 20 of sensors 22 by conventional means.

Figure 3A:
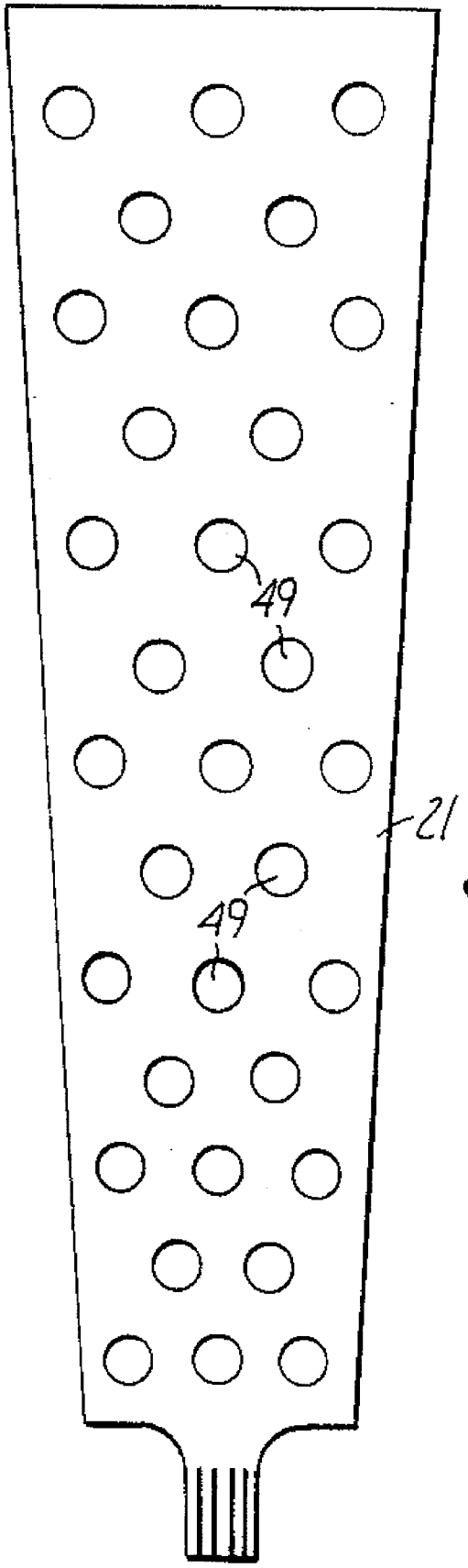
FIG. 3A is a plan view of a portion of the device of FIG. 2.
Figure 7:
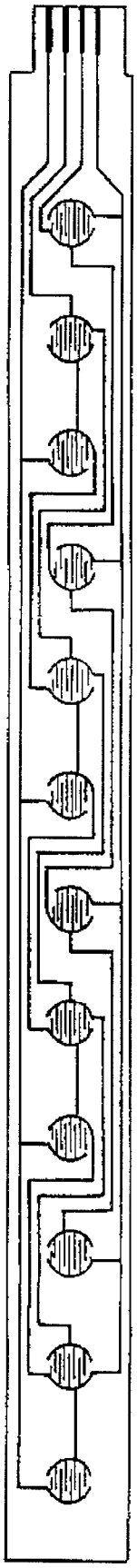
FIG. 7 is a plan view of a flexible metal circuit usable in the device of the invention.

The layout and configuration of the sensor array 20 on a flexible substrate 21 may vary from one application to another. FIG. 3A shows a plan view, somewhat schematically, of the sensor array depicted in FIG. 3—the array being sized so as to substantially completely cover the handle of the golf club with generally uniformly spaced sensors 22 when the array is wrapped around the handle of the club. Alternate configurations could also be utilized for the golf club, as well as for other sporting implements. For example, the array could comprise an elongated strip (such as is shown in FIG. 7) with a series of sensors in a one-dimensional array. Such a strip could be helically wound around the handle of a golf club, tennis racket, baseball bat, etc., to provide the desired coverage of the handle with sensors. Alternately, two or more such strips could be disposed in parallel fashion along the length of the handle of such a sporting implement. Various other suitable configurations could also be utilized. The primary objective to be achieved in configuring such an array is substantially covering that portion of the handle of the sporting implement which will be gripped by the sportsman.

Figure 5:
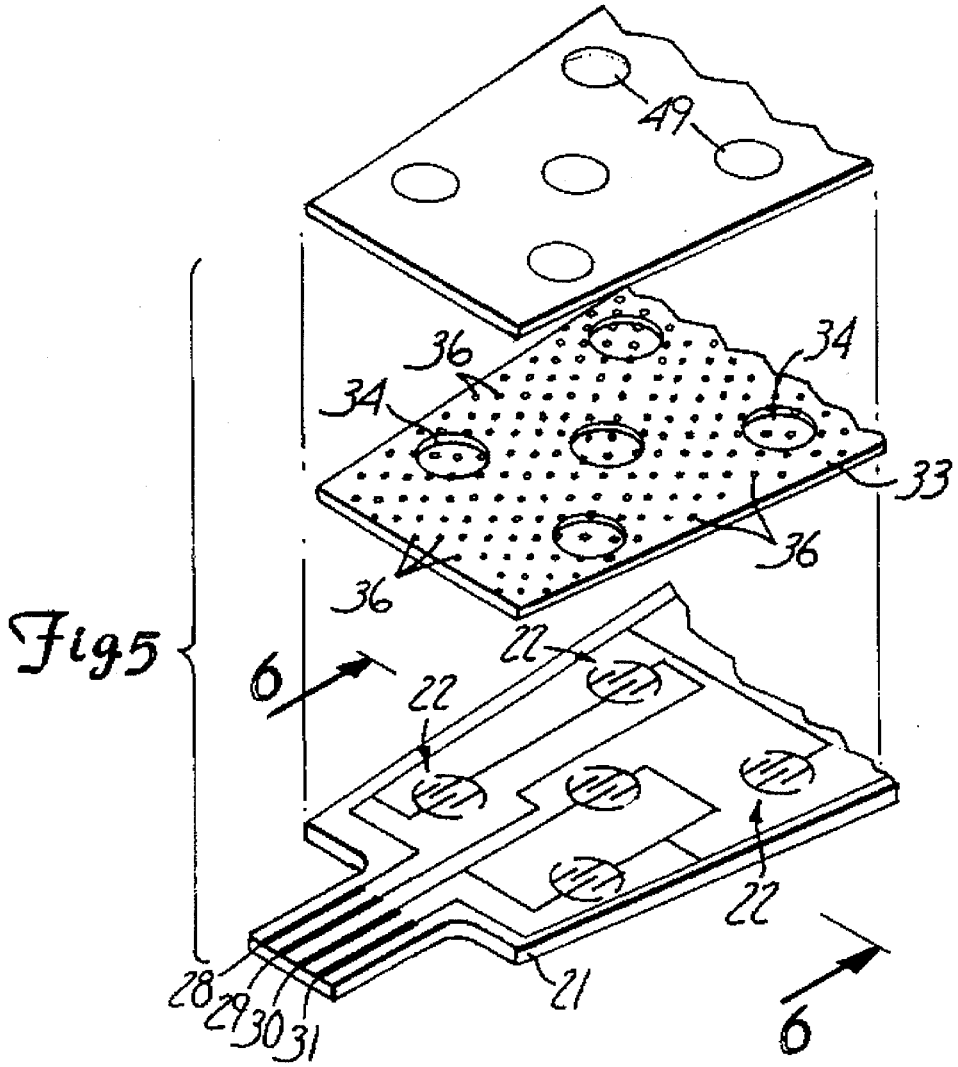
FIG. 5 is an exploded, perspective view of the device of FIGS. 2 and 3.

FIG. 5 depicts in exploded, broken-away fashion a preferred construction of the sensor array. In this preferred embodiment, each sensor comprises a digital switch which is normally open and is closed in response to grip pressure or swing torque exceeding a preselected level. Such switches can be constructed utilizing flexible thin film printed circuits. Typically, the switch constructed in this fashion includes two thin, flexible substrates, each carrying conductive paths aligned with one another. The substrates are spaced a short distance from one another by a preferably rigid spacer. The size, thickness, and positioning of the rigid spacer(s), as well as the flexibility of the outer of the two substrates, dictates the amount of force required to deflect the outer substrate toward the inner substrate, thus allowing the conductive traces to touch, completing an electrical circuit. Providing digital switches of this type gives the device significant advantages over prior art analog sensors (such as those utilized in the Budney and Searle patents identified above), in that the circuitry required is extremely simple and thin. Multiple switches of the type described can be connected in parallel to a small battery which in turn is connected to a low voltage signal, such as a magnetic or piezoelectric buzzer, or an LED. No further signal processing equipment is needed. An array of such switches can be easily manufactured to be less than 0.1 inches thick (including the thickness of the substrates)—desirably the switches are not more than about 0.03 inches thick, and most preferably, the switches are less than about 0.015 inches thick. Such thin film switches therefore add only an insignificant thickness to the handle of the sporting implement, and thus do not interfere with the sportsman's normal grip. Moreover, they can be manufactured quite economically.

In the particularly preferred embodiment of FIG. 5, a preferred construction for the thin film digital switches is illustrated. A first, base substrate 21 (preferably polyester or similar flexible substrate material commonly utilized in flexible circuits) carries a flexible metal circuit manufactured utilizing conventional flexible circuit manufacturing techniques. Typically, the first substrate 21 is approximately 0.004–0.006 inches thick, and carries a layer of tinned copper having a thickness of about 0.001 inches. The metal traces include a plurality of switch portions 22 which consist of a break or discontinuity in the circuit. An upper or top substrate 47 (typically polyester film of about 0.003–0.007 inches thick—most preferably about 0.005 inches thick) carries a plurality of flexible, very thin conductive patches 49. These patches may be made of any suitable conductive material, and preferably are a flexible carbon conductive material. The conductive patches 49 are positioned in alignment with the discontinuity in the switch portions 22 of the copper traces, and typically are about 0.001 inches thick.

A thin film of a suitable flexible adhesive 33 secures the two substrates 21 and 47 to each other, the adhesive having openings 34 therein so as not to insulate the conductive patches 49 from the switch portions 22 of the metal traces. The adhesive can be applied to one or both of the substrates 21 and 47, or it can itself be a discrete double-sided adhesive layer (e.g., incorporating the spacer described below). Typically the adhesive layer (or, in the case of two such layers, then each such adhesive layer) is on the order of a couple thousandths of an inch thick Means must be provided for assuring that the conductive patches 49 do not normally contact the switch portions 22 of the conductive traces. Since the switch portions 22 of the conductive traces desirably are many times wider than they are thick (so as to provide a thin film switch that covers a significant portion of the surface area of the array), it is desirable to have the spacer(s) disposed directly between the patch and switch portion of the traces. Accordingly, in a preferred embodiment, a pattern of rigid spacers 36 is disposed across substantially the entire area of each conductive patch 49, and, desirably, the pattern extends slightly beyond the conductive patch/switch portion of the conductive traces. The pattern may be of a variety of shapes, configurations and thicknesses to give the desired spacing between the patch and the electrical traces. Preferably the material utilized is flexible but substantially incompressible. A U.V. cured ink material, screened onto the upper substrate 47 (after the conductive patches 49 have been applied to the substrate 47) with a thickness on the order of 0.001–0.002 inches has worked well. The above dimensions permit the construction of the sensor array with an overall thickness in the range of about 0.01 to about 0.1 inches, and preferably about 0.015–0.020 inches. Because of the relative thinness of the device, it can comfortably be utilized on the handle of a sporting implement without significantly affecting the sportsman's natural grip.

The thickness and flexibility of the outer substrate 47 and the size and thickness of the rigid spacer pattern 36 together determine the amount of force necessary to deflect the substrate 47 sufficiently to allow contact of the conductive patch 49 with a switch portion 22 of the conductive traces. This level of force can be selected as desired for the particular application at hand. In many sports forces in the range of 20–60 psi are frequently desirable; in golf, the forces are typically at the lower end of that spectrum. In terms of direct force, Applicant has found that a force of approximately 0.2–0.3 lbs., e.g., as measured by a ¾ inch artificial "finger" made from 45 durometer silicone, provides a useful switch threshold. These numbers are given for illustrative purposes, it being recognized that the size and shape of the sporting implement, the typical strength of the person using it, and even such physiological factors as the relative boniness of one's hand will affect the optimum selection of switch activation thresholds.

Although all of the sensors in an array could be of the same force threshold, alternately the array could include at least two more sub-arrays, each having switches of different force thresholds (e.g., varying from one another by 10%–200%). Utilizing switches of multiple sensitivities (and permitting the sportsman to select which of these sub-arrays of switches is activated at a given time), allows great versatility in use of the device in varying situations. For example, the grip of a golfer on a putter is typically much lighter than the desired grip on a driver. Thus, when the device is utilized on the handle of a putter, switches activated with only a small amount of force can be selected, whereas when utilized on the handle of a driver, the golfer can select only switches requiring a larger amount of force.

Figure 6:
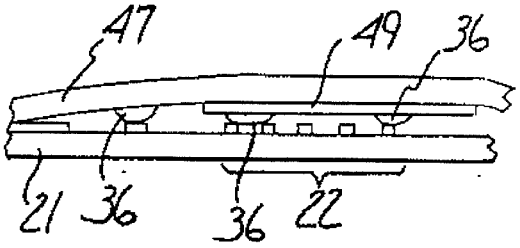
FIG. 6 is a cross-sectional view of the embodiment of FIG. 5, taken along line 6—6 thereof.

FIG. 6 illustrates a cross section of one of the switches (though not to scale, due to the thinness of the materials). The adhesive layer is not shown for purposes of clarity.

Figure 4:
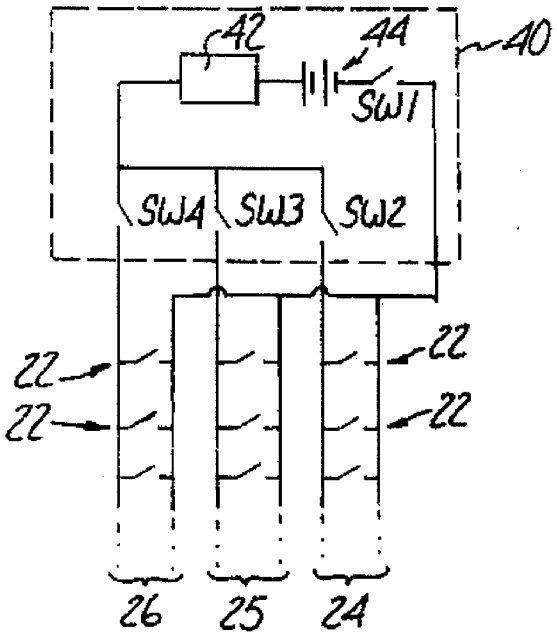
FIG. 4 is an electrical schematic diagram of one embodiment of the invention.

FIG. 4 illustrates schematically an exemplary circuit for a device utilizing three sub-arrays, corresponding to three sets of sensors uniformly distributed over the handle of the sporting implement. A battery 44 is connected in series with a signal device 42 (such as a piezoelectric buzzer). Power switch SW1, when closed, enables the device. Selector switches SW2, SW3, and SW4 can be closed, as desired by the sportsman, to selectively activate any one or two of the sub-arrays, or all three arrays, as desired. The four switches may simply be conventional dip switches, which can be easily manipulated by the point of a golfing tee, or similar readily available device or tool, and these dip switches, the battery and the buzzer may be easily packaged in a very small enclosure (identified generally as 40). When switch SW2 is closed, sub-array 24 is enabled. Similarly, when switch SW3 or switch SW4 is activated, sub-arrays 25 and 26, respectively, are enabled. (More or fewer sub-arrays could also be utilized; for example, two sub-arrays, each with a separately operable on-off switch gives the sportsman three choices—array A, array B, or both arrays A and B, all requiring just two switches).

When any one of the switches 22 in an enabled sub-array is closed, the electrical circuit is completed, and buzzer 42 emits an audible signal, alerting the sportsman to the fact that excess pressure has been applied. Since the signal is perceived by the sportsman in real time, the sportsman can immediately identify what portion of the stroke is causing the problem (e.g., the initial part of the back swing, the top of the back swing, just prior to hitting the ball, etc.).

FIG. 7 depicts one example of a circuit pattern where an elongated, one-dimensional array of sensors is utilized. The contacts at the top of the pattern are suitable for being plugged directly into a zero-insertion-force type of socket; other types of conventional connectors, including male/female type plugs, may also be utilized.

It will be appreciated that a variety of suitable circuit patterns could be utilized. For example, although the drawings generally depict substantially all of the circuitry carried on the lower substrate (the switch portions of the circuit comprising discontinuities which are bridged by the conductive patch on the opposing substrate), significant portions of the circuit could also be carried by the upper substrate 47. For example, conductive circuits on the lower substrate 21 could be juxta-posed across from complimentary traces on the upper substrate 47 which in turn are connected back to the signal means 40, the two sets of conductive paths being insulated from one another except for portions where they are juxtaposed across from one another to define a switch/sensor portion of the array. Other suitable configurations may also be utilized.

Figures 8, 9, 10:
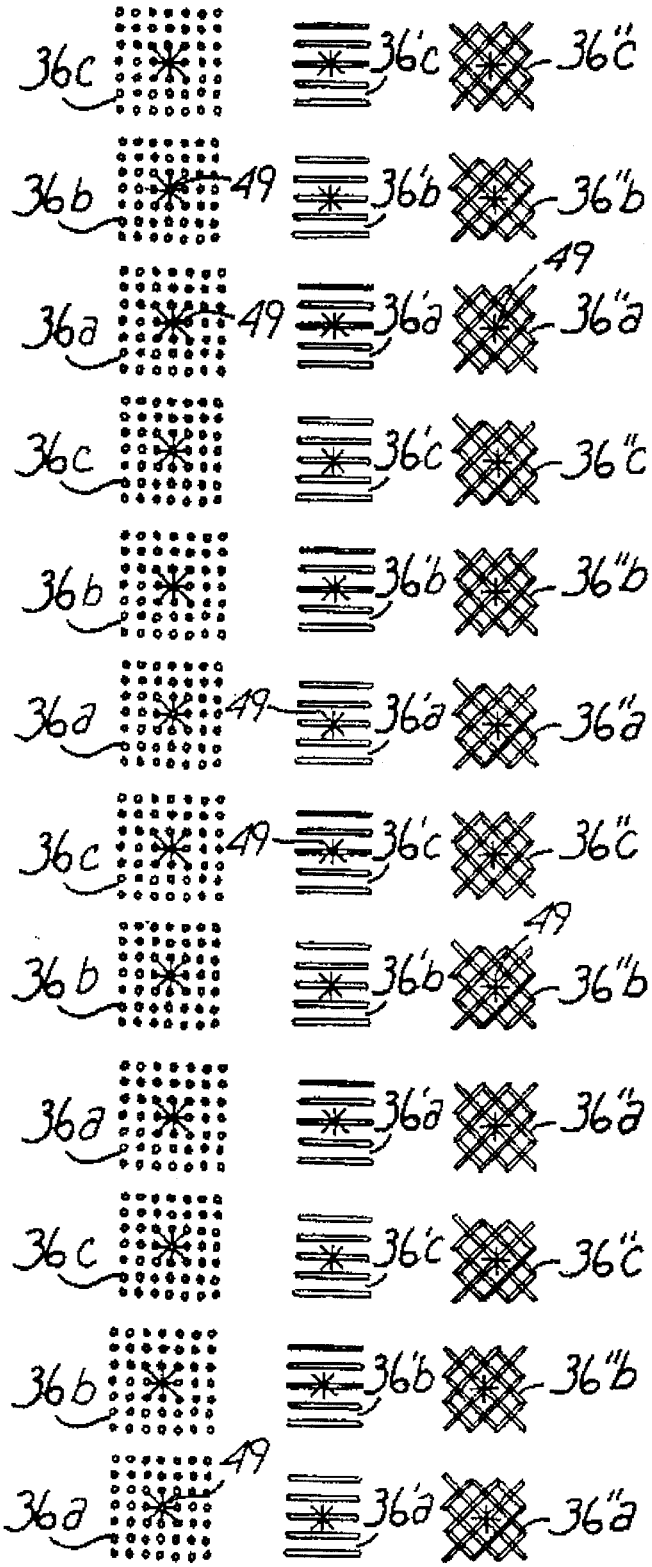
FIGS. 8–10 are plan views of various spacer patterns usable in connection with the device of the invention.

FIGS. 8–10 depict several variations of sizes and configurations for the rigid spacers disposed between the conductive patches 49 and the switch portions 22 of the flexible circuit. Each of these figures depicts a series of patterns that would be useful in conjunction with the circuit illustrated in FIG. 7, i.e., a linear array of twelve switches, the array being composed of three sub-arrays a, b, and c. Each of the sub-arrays has four switches with substantially identical pressure detection levels, and switches of the three sub-arrays are placed in the linear pattern "abcabcabcabc". In each case, the rigid spacer pattern 36*b* is a pattern that gives a switch a "medium" level of pressure sensitivity; the spacer pattern 36*c* has slightly wider spacing, thus giving the switch a slightly higher level of sensitivity (i.e., with spacers further apart, it is easier to deflect the outer substrate sufficiently to cause contact of the opposing conductive materials to complete the circuit); and the spacer pattern 36*a* has a slightly narrower spacing giving the switch a slightly higher level of sensitivity (i.e., making it more difficult to deflect the outer substrate). Thus, in FIG. 8, a series of dot-shaped spacers is illustrated, the bottom pattern having spacers 36*a*, the next pattern having spacers 36*b* of slightly farther apart, and the next pattern having spacers 36*c* even farther apart. The central "star" in each of these patterns represents schematically the location conductive carbon patch 49. In FIG. 9, rather than dots, the spacers comprise elongated strips 36*a*', 36*b*' and 36*c*', the strips being of varying widths. In FIG. 10, the spacers comprise a cross-hatch pattern 36"*a*, 36"*b* and 36"*c*. Other suitable patterns could also be utilized.

In use, the sportsman attaches the flexible sensor substrate (with its array of sensors) to the handle of the sporting implement being utilized. Such attachment may be by an adhesive on the back of the flexible substrate, by wrapping a thin layer of hand grip material (such as plastic or thin leather) around the device (as shown in FIG. 1), by placing an elastic sleeve over the device or by any other suitable means. The sportsman then attaches the signal device 40 by clipping it to the shaft of the handle and plugging it into the circuit carried on the flexible substrate. If the signal device is equipped with switches for enabling/disabling sub-arrays of sensors, the desired switches are selected to give the desired sensitivity to the device. (Alternately, a signal device 40 pre-set to automatically connect only to the desired sub-array(s) may be selected and mounted on the handle, the sportsman having several such signal devices each pre-set to automatically connect to a particular sub-array or set of sub-arrays.) The sportsman then uses the sporting implement in its ordinary fashion; if, during such use, pressure exceeding the selected threshold is exerted, the signal will go off, indicated such excess pressure. If the sportsman desires to change the sensitivity of the device, the selection switches can be manipulated to enable/disable the sub-arrays as desired (or, alternately, the signal device can be replaced with another signal device which is pre-set to automatically connect to the desired sub-array(s) of switches).

FIGS. 11–15 illustrate an alternate, preferred embodiment of the invention. A pair of sensor strips 120, each arrayed similarly to the strip depicted in FIG. 7, are disposed on opposite sides of the grip 112 of a golf club (this preferred embodiment could also be easily utilized with other sporting implements, but description of it is given in connection with golf clubs). The proximal (top) ends of these sensor strips 120 are contained in a housing 140 mounted on the top end of the golf club handle. The housing 140 contains the battery and rudimentary circuitry for connecting the sensor switches contained on the sensor strips 120 to the on-off switches 122 and the feedback device (in this case, an audible buzzer 142—other feedback devices, such as a blinking LED, etc. could also be used). The circuitry for this embodiment essentially consists of two sets (or sub-arrays) of twelve sensors, the two sets having slightly different sensitivity and being preferably distributed along each of the sensor strips 120 in an "abababababab" configuration. Each set is independently connected through one of the two switches 122 to the battery and the buzzer 142. When the corresponding switch is enabled and any one of the sensors in a particular set is depressed, it completes the electrical circuit to power the buzzer, emitting an audible signal to the sportsman. One or both of the sets of sensors may be enabled, as desired by the sportsman.

Figure 11:
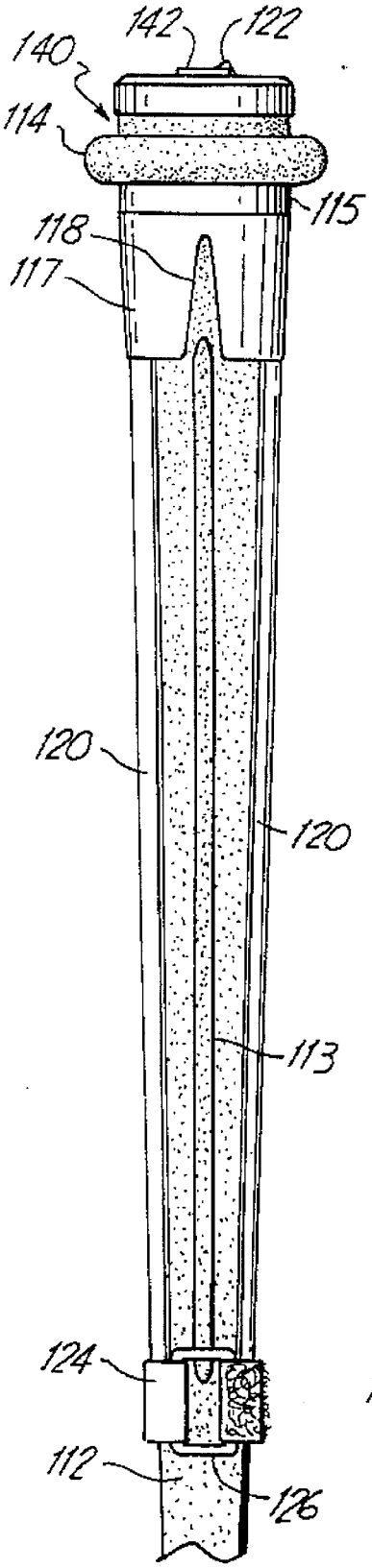
FIG. 11 is a side elevational view of an alternate embodiment of the invention, showing the tubular hand grip sheath in the rolled up configuration.
Figure 13:
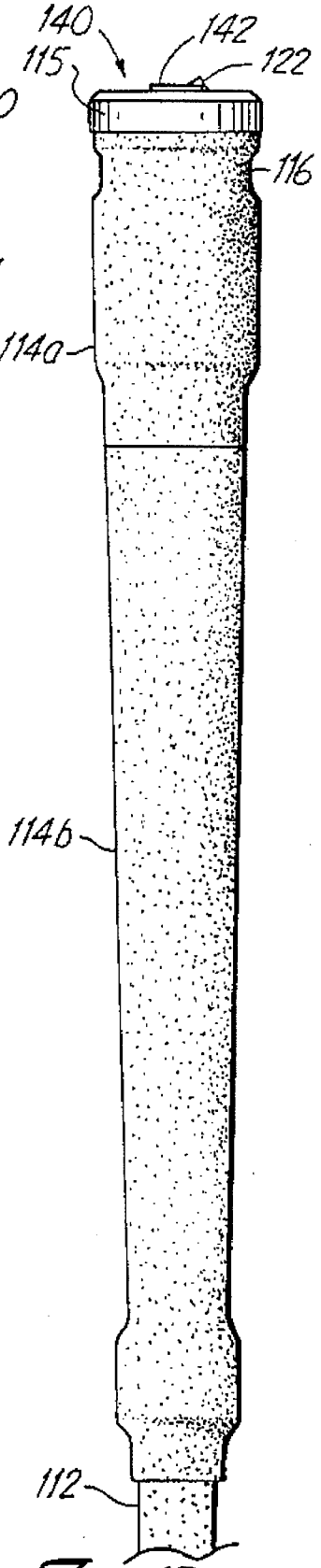
FIG. 13 is a side elevational view similar to FIGS. 11 and 12 with the tubular sheath completely unrolled.

Attachment means is provided for securing the sensor strips 120 and the housing 140 to the handle of the golf club (or other sporting implement). The attachment means includes an elongated, stretchable tubular sheath 114 which is capable of being manipulated from a first position, in which it is rolled substantially entirely onto itself to form a generally doughnut-shaped roll (as shown in FIGS. 11 and 14), to a second position in which it is unrolled over the sensor strips 120 and the grip 112 of the golf club (as shown in FIG. 13).

The tubular sheath may be made from a variety of suitable materials. Desirably the material has sufficient elasticity to snugly hold the sensor strips 120 against the handle of the golf club, causing them to generally conform to the shape of the handle. Also, to make the golf club feel as natural as possible, desirably the sheath material is relatively thin (typically in the range of about 0.1 to about 0.01 inches), so that a golfer can utilize the device of the invention on his or her regular set of clubs without substantially changing the feel of those clubs or the golfer's grip/hand position on the club. In a preferred embodiment, the material is slightly thicker at the proximal (upper) end of the sheath (114*a* in FIGS. 12–13), and slightly thinner at the distal (lower) end (114*b* in FIGS. 12–13). Desirably the material at the proximal end is about 0.01 inches to about 0.08 inches thick, and preferably about 0.03 to about 0.04 inches thick. Desirably the material at the distal end is about 0.005 inches to about 0.05 inches thick, and preferably about 0.014 to about 0.02 inches thick. These differences in thickness can be achieved, for example, by placing one or more extra layers of material on the proximal end portion 114*a* (e.g., when the sheath is formed by dipping a mandrel in a solution of rubber latex material, the proximal end portion can be dipped one or more extra times, and the subsequent dippings can therefore easily utilize material different in properties or appearance).

In a preferred embodiment, an outer layer of latex material is formed on just a portion of the proximal end in a different color to identify for the golfer the proximal portion on which the golfer should not place his hands when gripping the club.

The diameter of the tubular sheath should be smaller than the diameter of the handle onto which the device of the invention is to be mounted. Applicant has found that on a golf club grip tapering from a larger proximal diameter of about 1.3 inches to a smaller distal diameter of about 0.75 inches a stretchable tubular sheath of about ⅝ inches in diameter (relaxed state) works well. Diameters and thicknesses of the material may vary from one application to another based on the particular size, shape and durability required.

Suitable materials for the tubular sheath 114 include certain rubber latex materials available commercially from North American Latex Corp. (Sullivan, Ind.) and Totes Incorporated of Loveland, Ohio. These companies are offer formulations that provide a very comfortable hand feel (i.e., slightly tacky) while permitting the material to be repeatedly rolled and unrolled.

Preferably the tubular sheath 114 is carded on a removable plastic collar 115 (see FIGS. 11 and 14) that snugly fits over the housing 140. Removability of the collar (with the sheath) facilitates assembly of the device, allows the sheath to be easily replaced if it becomes damaged, and even allows a golfer to select from different colors at will. Desirably the collar is formed to include a generally centrally located trough or groove 116 to assist in holding the sheath 114 in its rolled up position. That is, the trough tends to prevent the rolled up sheath from accidentally unrolling, and, when the sheath is being rolled up, the trough 116 tends to prevent the sheath from being rolled right off the end of the collar. The trough 116 may be formed integrally as part of the collar, or may at least in part be formed by materials used to secure the proximal end of the sheath to the collar (such as tape, adhesive, retaining, rings, etc.).

To assist in stabilizing the housing 140 with respect to the golf club handle, preferably a tapered skirt 117 is provided, the skirt being secured to the housing 140 and extending distally from the housing to at least partially surround the proximal end of the handle grip 112. The skirt 117 helps to center the housing 140 with respect to the handle of the golf club, and assists in maintaining the physical orientation of the housing with respect to the handle. Desirably the skirt has an internal diameter sized to closely receive the end of a golf club grip—typically on the order of about 1.0 inches to about 1.2 inches. Preferably the lower portion of the skirt tapers inwardly, both in internal diameter, and external diameter, so as to provide a gentle transition from the diameter of the housing 140 and collar 115 to the diameter of the golf club grip. The skirt may be secured to the housing through any suitable means. In FIG. 14, a shoulder 141 extends radially outwardly from the housing, the shoulder being sized to be received in a complementary groove 138 formed on the inside of the skirt. Other suitable attachment means may also be employed.

Indicia may be provided on the device for rotationally aligning the device with respect to the sporting implement. For example, many golf club grips have a marking (such as that designated by reference numeral 113 in FIG. 11) to assist the golfer in aligning ones hands with the correct orientation of the club. Utilizing this grip marking 113, a similar corresponding marking can be placed on the device of the invention to assist the golfer in mounting the device on the club handle in the proper orientation. In the drawings, the skirt is shown as being provided with a slot 118 for this purpose. Other suitable markings could similarly be used. The slot is advantageous because it also provides a certain measure of added flexibility to the lower end of the skirt, making the device more easily adaptable to club handles of slightly different diameters.

In certain applications it is also desirable to provide the skirt or housing with a longitudinally extending stabilization peg 119. Most golf club grips include a centrally located hole 111 in the upper end of the grip (the hole serving as a vent for escape of trapped air as the grip is being slid onto and over the end of the club shaft when the grip is assembled to the golf club). Desirably peg 119 is of an outer diameter slightly larger than the typical hole 111, providing a snug fit between the two parts. The peg adds dimensional stability to the device. On some clubs, such as putters, where the forces encountered by the device in use are substantially less, the peg 119 may not be necessary.

The means for attaching the device to a golf club handle may also include a strap 124 secured to the distal (lower) end of the sensor strips 120. The strap helps to maintain the opposing orientation of the strips, and tends to reduce any tendency of the strips to twist around the handle during use. As with the stabilizing peg 119, the strap is less necessary with clubs encountering more gentle use, such as putters. The strap may be made of any suitable materials. In the drawings, a hook and loop type of strap is employed, with the strap being attached to the distal end portion of each sensor strip 120 by a rivet, eyelet, or equivalent means (not shown in the drawings). One end of the strap carries a permanently attached buckle-type loop; once the device is placed on the handle of a club, the free end of the strap can be threaded through the buckle, and folded back on itself securing hooks to loops and securing the distal end of the device to the golf club handle.

Figure 12:
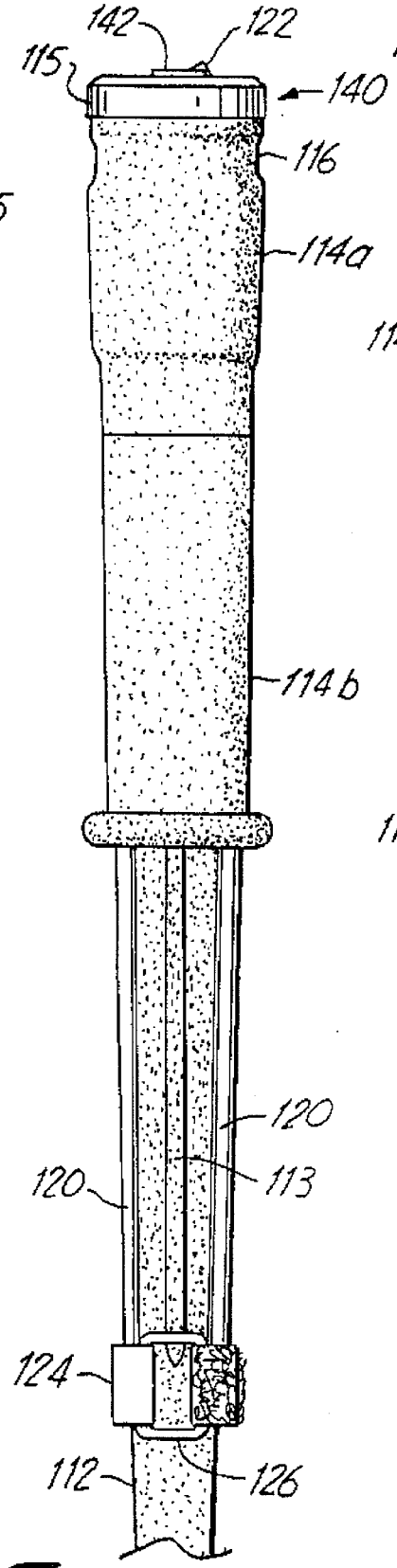
FIG. 12 is a side elevational view similar to FIG. 11 with the tubular sheath partially unrolled.

In use, the sportsman mounts the unit to the handle of the sporting implement being utilized (e.g., a golf club). The end of the club handle is inserted into the skirt to full depth (with the optional peg being inserted into the hole in the end of the handle grip). If the unit has a distal strap 124, it is secured about the handle grip. The alignment groove in the skirt may be utilized to assure proper rotational alignment of the device with respect to the club. At this stage, the device would appear as in FIG. 11. the tubular sheath may then be unrolled, as shown in FIG. 12, to protect the sensor strips and to more firmly secure the entire device to the club handle. When the sheath is completely unrolled, the unit appears as in FIG. 13. Although FIG. 13 depicts the sheath as entirely covering even the strap 124, alternately the sheath could be sized to terminate just proximal to the strap.

If the sportsman wishes to remove the device, this process can easily be reversed by rolling up the sheath, loosening the buckle, and removing the unit. If the sheath becomes damaged or the golfer for other reasons wishes to change the sheath, the sheath collar 115 can be removed with the sheath when the sheath is in the rolled up configuration.

Figure 16:
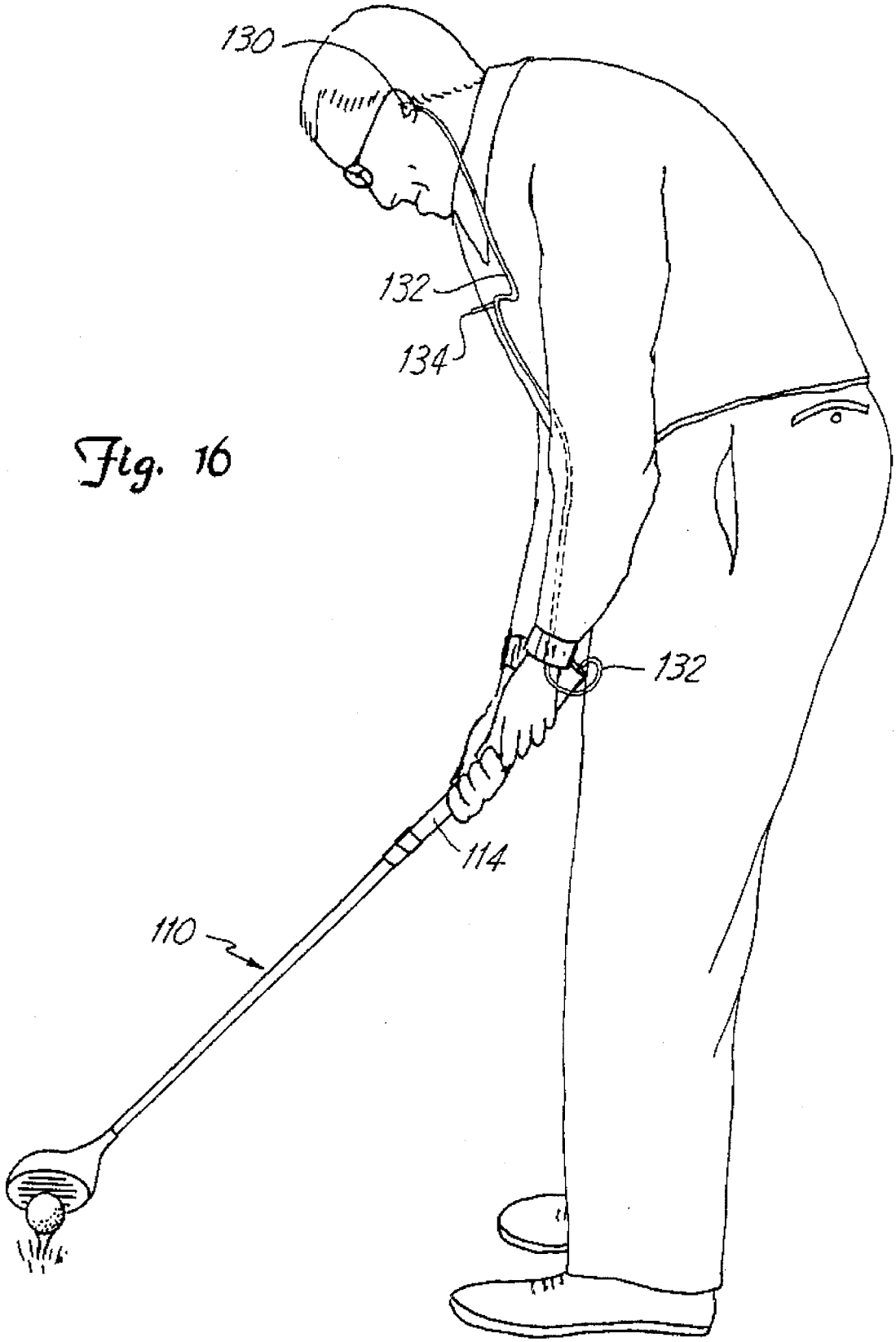
FIG. 16 shows an alternate embodiment with the device of the invention including a personal listening adaptor.

With the unit properly installed on the sporting implement, one or both of the switches 122 can be activated to enable the device. The sportsman then uses the sporting implement in its ordinary fashion; if, for example, during any portion of a golfer's swing the golfer squeezes hard or jerks the club, pressure exceeding the selected threshold of the sensors is exerted, the signal will go off, indicated such excess pressure and providing immediate audible feedback to the sportsman of this fact. If the sportsman desires to change the sensitivity of the device, the selection switches can be manipulated to enable/disable the sub-arrays as desired. For privacy, the unit can be equipped with a personal listening device, such as pneumatic tube 132, clip 134 (for attaching the tube to one's shirt), and earpiece 130 as shown in FIG. 16. Alternately, for some applications (such as putters) the audible buzzer can be replaced with a visual feedback device, such as a blinking LED, or any other suitable monitoring or signalling device.

While a preferred embodiment of the present invention has been described, it should be understood that various changes, adaptations and modifications may be made therein without departing from the spirit of the invention and the scope of the appended claims.

What is claimed is:

1. A biosensor feedback device for use in detecting a grip pressure of a hand against a handle of a sporting implement, comprising:

electronic pressure detection means for detecting and signalling hand pressure on the sporting implement handle exceeding a predetermined level, the pressure detection means including one or more portions of sensor substrate being generally conformable to the handle and including pressure sensor means for sensing grip pressure; and attachment means for securing the sensor substrate to the handle of the sporting implement, the attachment means including a housing and an elongated, stretchable tubular sheath rolled substantially entirely onto itself to form a generally doughnut-shaped roll on the housing, the sheath being capable of being unrolled over the sensor substrate.

2. The device of claim 1 wherein the attachment means includes a strap secured to the one or more portions of sensor substrate, the strap including fastening means for releasably securing the strap, and, hence, the adjacent portion of the sensor substrate, to the handle of the sporting implement.

3. The device of claim 1 wherein the stretchable tubular sheath is made from an elastically distensible latex rubber.

4. The device of claim 1 wherein the stretchable tubular sheath is of a thickness of about 0.01 inch to about 0.1 inch.

5. The device of claim 1 wherein the stretchable tubular sheath is of a thickness of about 0.014 inch to about 0.040 inch.

6. The device of claim 1 wherein the stretchable tubular sheath, in its relaxed state, is thicker at one end and thinner at an opposite end.

7. The device of claim 6 wherein the thickness of the stretchable tubular sheath at its thicker end is about 0.01 inch to about 0.08 inch, and the thickness at the opposite end is about 0.005 to about 0.05 inch.

8. The device of claim 6 wherein the thickness of the stretchable tubular sheath at one end is at least about 50% greater than the thickness at the opposite end.

9. The device of claim 6 wherein the thickness of the stretchable tubular sheath at one end is at least about 100% greater than the thickness at the opposite end.

10. The device of claim 1 wherein the diameter of the stretchable tubular sheath, in its relaxed state, is at least about 10% less than the diameter of the handle of the sporting implement.

11. The device of claim 10 wherein the handle of the sporting implement includes first and second portions, the first portion having a larger cross-sectional diameter than the second portion, the stretchable tubular sheath, in relaxed state, having a cross-sectional diameter that is at least about 10% less than the cross-sectional diameter of the second section of the sporting implement handle.

12. A biosensor feedback device for use in detecting a grip pressure of a hand against a handle of a sporting implement, electronic pressure detection means for detecting and signalling hand pressure on the sporting implement handle exceeding a predetermined level, the pressure detection means including a housing and one or more portions of sensor substrate being generally conformable to the handle and including pressure sensor means for sensing grip pressure; and attachment means for securing the sensor substrate to the handle of the sporting implement, the attachment means including an elongated, stretchable tubular sheath;

the tubular sheath being secured to a collar removably mountable to the housing of the electronic pressure detection means.

13. A biosensor feedback device for use in detecting a grip pressure of a hand against a handle of a sporting implement, comprising:

electronic pressure detection means for detecting and signalling hand pressure on the sporting implement handle exceeding a predetermined level, the pressure detection means including a housing, including a distally extending skirt sized and shaped to receive therein an end of the sporting implement handle, and one or more portions of sensor substrate being generally conformable to the handle and including pressure sensor means for sensing grip pressure; and attachment means for securing the sensor substrate to the handle of the sporting implement, the attachment means including an elongated, stretchable tubular sheath.

14. The device of claim 13 wherein the skirt includes indicia for rotationally aligning the biosensor feedback device with respect to the sporting implement.

15. The device of claim 14 wherein the indicia includes a notch formed in the skirt.

16. A biosensor feedback device for use in detecting a grip pressure of a hand against a handle of a golf club of the type having a handle grip with a hole in the central portion of its proximal end, comprising:

electronic pressure detection means for detecting and signalling hand pressure on the sporting implement handle exceeding a predetermined level, the pressure detection means including a housing and one or more portions of sensor substrate being generally conformable to the handle and including pressure sensor means for sensing grip pressure; and attachment means for securing the sensor substrate to the handle of the sporting implement, the attachment means including an elongated, stretchable tubular sheath;

the attachment means including a stabilizing peg extending distally from the housing of the electronic pressure detection means, the stabilizing peg being sized to be snugly received in the hole in the golf club handle grip.

17. A biosensor feedback device for use in detecting a grip pressure of a hand against a handle of a sporting implement, comprising:

electronic pressure detection means for detecting and signalling hand pressure on the sporting implement handle exceeding a predetermined level, the pressure detection means including a housing mountable to an end of the sporting implement handle, and one or more portions of sensor substrate being generally conformable to the handle and including pressure sensor means for sensing grip pressure; and attachment means for securing the sensor substrate to the handle of the sporting implement, the attachment means including a collar removably mountable to the housing of the electronic pressure detection means and an elongated, stretchable tubular sheath secured to collar, the sheath being made from an elastically distensible latex rubber of a thickness of about 0.01 inch to about 0.1 inch.

18. A biosensor feedback device for use in detecting grip pressure of a hand against a handle of a sporting implement, comprising:

an electronic pressure detector including one or more portions of sensor substrate being generally conformable to the sporting implement handle; and a housing and an elongated, stretchable tubular sheath rolled substantially entirely onto itself to form a generally doughnut-shaped roll on the housing, the sheath being capable of being unrolled off the housing over the sensor substrate to secure the sensor substrate to the handle of the sporting implement.

* * * * *